United States Patent [19]

Schmidt et al.

[11] 3,973,700

[45] Aug. 10, 1976

[54] BELLOWS PUMP WITH EXTENSION HAVING INTEGRAL VALVES

[76] Inventors: Edward C. Schmidt, 2755 Powell Drive; Miroslav Uroshevich, 2505 Fleetwood Ave., both of Cincinnati, Ohio 45211

[22] Filed: Sept. 29, 1975

[21] Appl. No.: 617,385

[52] U.S. Cl. ..... 222/153; 222/207; 222/380

[51] Int. Cl.[2] ..... B67D 1/02

[58] Field of Search ..... 222/207, 209, 383, 153, 222/380, 558

[56] References Cited

UNITED STATES PATENTS 1,647,219 11/1927 Fulton ..... 222/207

3,160,329 12/1964 Radic et al. ..... 222/207 X

*Primary Examiner*—Allen N. Knowles
*Assistant Examiner*—Hadd Lane
*Attorney, Agent, or Firm*—Irwin P. Garfinkle

[57] ABSTRACT

A pump or spray is comprised of a flexible bellows having a non-collapsible extension in which there are inlet and outlet ports. Flapper valves, integral with the extension, open and close the ports on the compression and expansion strokes of the bellows. The bellows may be finger or trigger operated.

15 Claims, 4 Drawing Figures

BELLOWS PUMP WITH EXTENSION HAVING INTEGRAL VALVES

BACKGROUND OF THE INVENTION

This invention relates to a hand-held liquid, finger-operated pump and trigger sprayer of the type conventionally attachable to bottles containing liquids, such as detergents, soaps, lotions and insecticides. Many devices of this general type are well known in the prior art. One presently used trigger-type of these devices is disclosed in U.S. Pat. No. 3,061,202 issued to Tyler on Oct. 30, 1962. This patent shows a trigger-operated piston pump threaded onto a bottle. After priming, liquid is forced through a nozzle on the compression stroke of the piston and the cylinder refills on the intake stroke. Another presently used sprayer is disclosed in U.S. Pat. No. 3,749,290 issued to Miscallef on July 31, 1973. This patent discloses flexible tubular member which defines a pump chamber, the volume of the chamber being varied by distorting the tube. The present invention operates on the same general principles as the Tyler and Miscallef, but it is far less complex and expensive in that it uses a resilient bellows as the variable volume pump chamber, and all the required valving is molded integrally with an extension from the bellows structure.

Finger-operated pumps are also well known in the art; for example, see Malone, U.S. Pat. No. 3,396,874 and Corsetts, U.S. Pat. No. 323,757. Both of these patents show finger-operated pumps, but neither uses bellows piston having integral valving.

Stengle U.S. Pat. No. 3,409,184 also shows a bellows structure but it fails to teach the use of integral flaps for intake and discharge valving.

Other prior art known to the Applicants includes U.S. Pat. Nos. 788,863, 928,059, 2,112,548, 2,446,085, 2,878,974, 3,128,018, 3,146,920, 3,187,960, 3,237,571, 3,298,573, 3,396,874, 3,572,590 and 3,642,180. None of these is regarded as anticipatory.

SUMMARY OF THE INVENTION

The invention is directed to a pump or spray which uses a resilient compressible bellows having integral intake and discharge valves. The pump is housed within a hollow hand grip furnished with a threaded bottle cap for securing the pump to a conventional bottle. The pump may be finger-operated or it may be operated as a spray by means of a trigger initially locked in a pump-disabling position.

THE DRAWINGS

DESCRIPTION OF THE ILLUSTRATED EMBODIMENT

Figure 1:
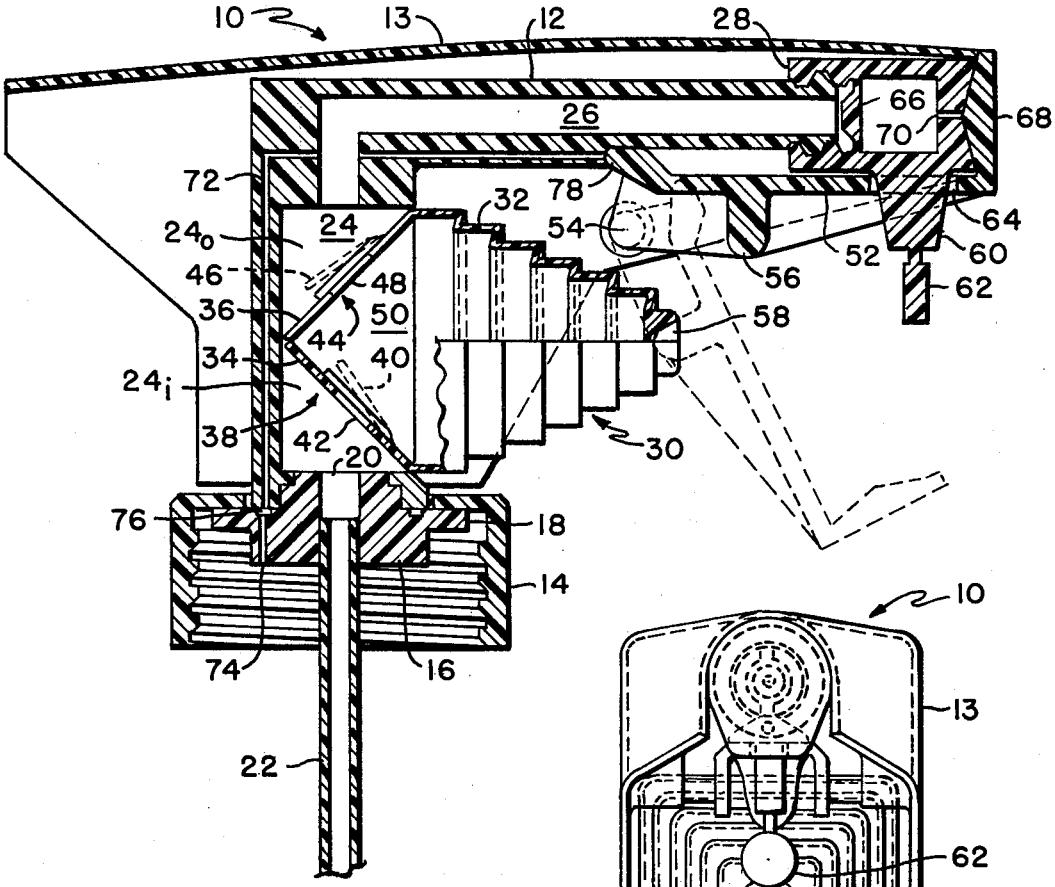
FIG. 1 is a cross section of a trigger-operated spray made in accordance with this invention.
Figure 2:
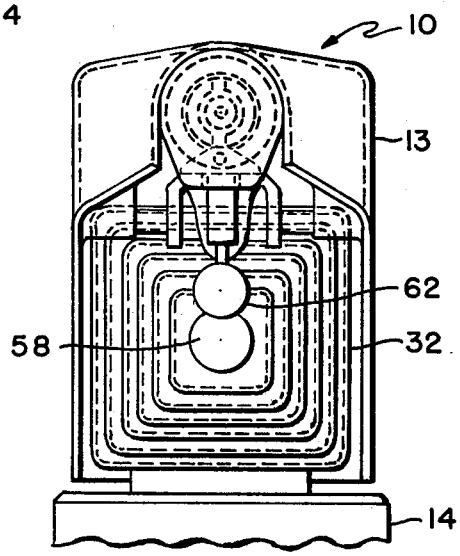
FIG. 2 is an end view of FIG. 1.
Figure 3:
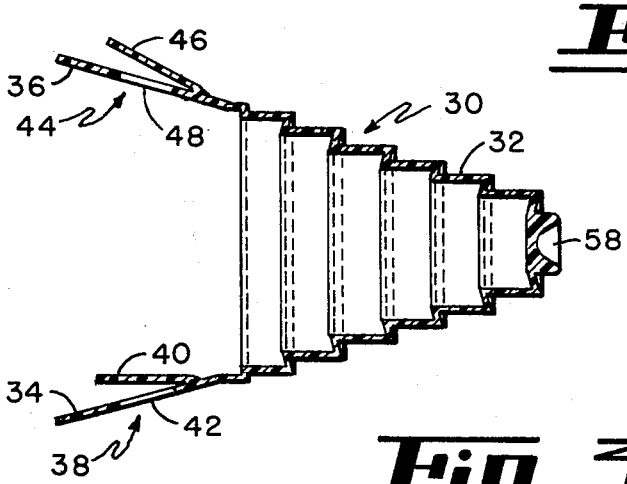
FIG. 3 is a sectional view of the bellows piston and valves prior to installation.

Referring to FIGS. 1–3, the illustrated sprayer 10 is intended for use in conjunction with a liquid container, preferably a glass or plastic bottle (not shown). The sprayer is constructed of a molded body 12, preferably made in two pieces which are bonded together, and contains a plurality of chambers and conduits which are integrally formed within the body 12 for purposes hereinafter to be explained. A housing 13, formed as a pistol grip, is bonded to and encloses the body 12.

The body 12 is connectable to a bottle by means of a threaded cap 14 loosely secured to the base of the body by means of a plug 16. The cap 14 rides on the flange 18 of plug 16 which is fixed in the base of the body.

When threaded onto a bottle, an inlet bore 20 in the plug and a flexible tube 22 extending into the liquid permit communication between the liquid and a chamber 24 in the housing. An outlet bore 26 provides communication between chamber 24 and an adjustable nozzle 28.

The chamber 24 is rectangular in cross section and is formed with an open front side into which a bellows piston 30 is inserted and secured. The bellows piston assembly 30 is shown prior to insertion in FIG. 3. It consists of a bellows 32 formed of a resilient material, preferably plastic or rubber. The bellows 32 is rectangular in end view, as seen in FIG. 2.

Integral tabs 34 and 36 extend from the top and bottom sides of the bellows 32 and have pump inlet and outlet valves formed integrally therein. Pump inlet valve 38 in tab 34 comprises an inwardly positioned flap 40 located over inlet port 42. Pump outlet valve 44 comprises an outwardly positioned flap 46 located over outlet port 48.

When inserted into chamber 24 the tabs 34 and 36 are squeezed together and forced against the inner, back and side walls of chamber 24. The assembly 30 is then secured in place, dividing the chamber 24 into an inlet reservoir $24_i$, and outlet reservoir $24_o$ and the variable volume 50 between the tabs 34 and 36. The method of attachment of the tabs to the body may take many other forms. For example, guides may be provided for sliding the tabs in place, and snap fitting may be used for securing the parts.

When installed, the assembly 30 comprises a variable volume chamber 50 having an inlet at port 42 and an outlet at port 48. When the volume of the chamber 50 is reduced by compressing the bellows 32, the pressure in the chamber 50 causes flap 40 to close in the inlet port 42 and causes flap 46 to open outlet port 48. When the chamber 50 expands, the operation of the flaps is reversed. Thus, the bellows and valve arrangement provide a conventional pumping cycle in which fluid is drawn during the intake (or expansion) stroke through tube 22 and bore 20 into the reservoir $24_i$ and through the intake valve 38 into chamber 50. During the compression stroke the liquid is forced out of chamber 50 into reservoir $24_o$ and into conduit 26.

The bellows assembly 30 is compressed by means of a trigger-type lever 52 pivoted at 54 from the housing 13. Intermediate the ends of the trigger is a lug 56 which mates, when actuated, with a cavity 58 formed in the end of bellows 32.

In addition to its use as an actuator for the bellows, lever 52 is also used to seal and lock the nozzle 28. As seen in FIG. 1, the end of the body 12 is threaded to receive the nozzle 28. The nozzle 28 carries a tab 60 which in turn carries a disc 62. The lever 52 is slotted at 64 to permit the passage of the tab therethrough. However, the disc 62 is set at an angle with respect to slot 64 so that the tab cannot be removed without first breaking off the disc.

When released, the tab 60 serves to permit rotation of the nozzle with respect to the body 12 to adjust the distance of a disc 66 in the center of the nozzle from the end of the outlet conduit 26.

A projection 68 on the lever serves to seal the outlet port 70 from the nozzle.

A vent for the bottle to which the spray may be connected is provided by means of a small duct 72 molded in the body 12 and a similar duct 74 in the plug. The need for alignment of the duct is obviated by incorporating an annular groove 76 in the plug 16. The end 78 of lever 52 serves to seal the duct 72 when the lever is in the locked position.

Figure 4:
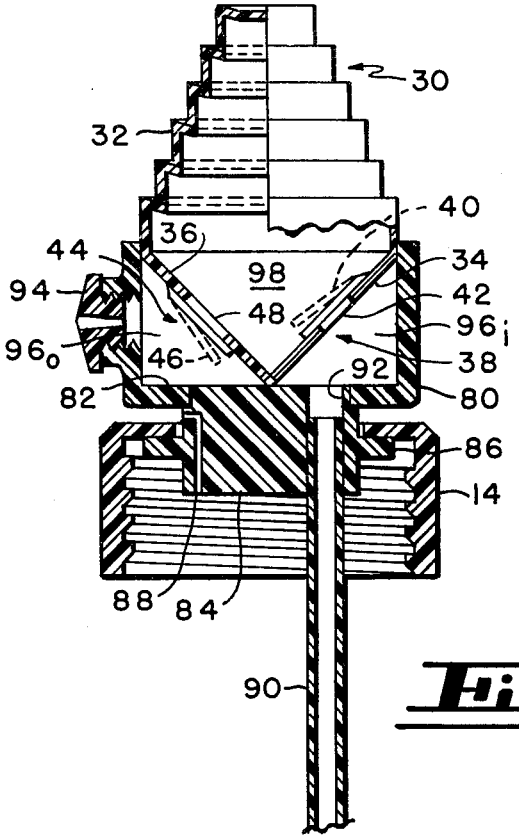
FIG. 4 is a cross-sectional view of an alternative arrangement showing a finger pump configuration.

In the alternative arrangement shown in FIG. 4, the bellows 32 is vertically oriented with respect to the bottle cap 14 by which the pump is attached to a bottle (not shown), and it is finger operated rather than trigger operated. The pump shown in FIG. 4 is constructed of a molded hollow rectangular body 80 having an open upper end into which the tab 34 and 36 of the pump 32 extend, and a closed lower end having a circular aperture 82. The aperture 82 is closed by means of a plug 84 which is glued in place to the body after being projected through the cap 14. A flange 86 on the plug retains the cap 14.

A port 88 through the plug provides an air vent. A tube 90 is frictionally held in a bore 92 extending through the plug 84. The body 10 has a spray nozzle 94 threaded into an aperture.

The bellows 32, when attached within the body 80, divides the hollow interior volume of the body into three sections, an inlet reservoir $96_i$, and outlet reservoir $96_o$, and the variable volume 98 between the tabs 34 and 36. When the volume 98 is reduced by compressing the bellows 32, the increased pressure in the chamber 90 causes flap 40 to close inlet port 42 and causes flap 46 to open outlet port 48. When the chamber 50 expands, the operation of the flaps is reversed. Thus, the bellows and valve arrangement provides a conventional pumping cycle in which fluid is drawn the intake stroke through the tube 90 and bore 92 into the intake reservoir $96_i$, and through the intake valve 38 into chamber 98. During the compression stroke the liquid is forced out of the chamber 98 and into the reservoir $96_o$ and into the nozzle 94.

While two embodiments of the invention have been illustrated, it will be apparent that the invention is susceptible of a variety of variations. For example, the bellows may be made circular or have any other cross section other than rectangular. In addition, the tabs need not be flexed (as disclosed) into a chamber dividing position but may be initially molded into an appropriate configuration. For example, the tabs may be a rectangular or circular extension of the bellows and may be closed at the end so that the bellows in combination with the extension provides the entire pump chamber.

In addition, while the invention is shown in combination with a threaded attaching device, it is apparent that it may be snap fitted to a container. Further, while the tabs 34 and 36 are preferably made integrally with the bellows, these elements can be separately made and subsequently bonded together.

We claim:

1. A fluid pump comprising:

a variable volume, axially collapsible resilient bellows closed at one end and open at the other end;

means for closing said open end, said means including a non-collapsible extension;

an inlet port and an outlet port in said extension; and a pressure-responsive flexible valve for each of said input and output ports, a respective valve closing said input port and opening said output port in response to a pressure increase within said variable volume, and closing said output port and opening said input port in response to a decrease in pressure within said volume, said valves being integral with said extension.

2. The invention as defined in claim 1 wherein said extension comprises first and second opposed tabs extending from the open end of said bellows, said first tab having said inlet port, said second tab having said outlet port, said flexible valves being integral with said tabs, one of said valves being positioned outside of said volume, other of said valves being located inside of said volume.

3. The invention as defined in claim 2 wherein said extension is integral with said bellows.

4. The invention as defined in claim 3 wherein the distal ends of said extensions are joined.

5. The invention as defined in claim 4 wherein said valves are flaps.

6. A pump comprising:

a body having a chamber therein and an inlet duct and an outlet duct in communication with said chamber, said chamber having an opening through a wall of said body;

a variable volume device including a resilient collapsible bellows having non-collapsible extension, sad extension projecting into said chamber through said opening, and closing of said opening;

an inlet port and an outlet port in said extension;

a first flap integral with said extension for closing said inlet port in response to an increase in pressure within said volume; and a second flap for closing said output port in response to a decrease in pressure within said volume.

7. The invention as defined in claim 6 wherein said body is connected to a bottle cap.

8. The invention as defined in claim 7 wherein a tube connected to said inlet duct projects through said bottle cap.

9. The invention as defined in claim 8 wherein said bottle cap is provided with vent.

10. The invention as defined in claim 9 wherein said body has an opening by a plug, said plug extending through said cap, said plug having a flange for retaining said cap.

11. The invention as defined in claim 10 wherein said vent comprises an annular groove in said plug, and a hole extending from said groove through said plug

12. The invention as defined in claim 11 wherein said groove communicates with a duct through said body.

13. The invention as defined in claim 12 and a trigger pivoted from said body for axially collapsing said variable volume device.

14. The invention as defined in claim 13 and means for disabling said trigger to prevent movement of said trigger to collape said bellows.

15. The invention as defined in claim 14 wherein said trigger closes said duct when said trigger is disabled.

* * * * *

UNITED STATES PATENT OFFICE

CERTIFICATE OF CORRECTION

PATENT NO. : 3,973,700

DATED : August 10, 1976

INVENTOR(S) : Edward C. Schmidt & Miroslav Uroshevich

It is certified that error appears in the above-identified patent and that said Letters Patent are hereby corrected as shown below:

Col. 1, line 19, "discloses flexible" should read -- discloses a flexible -- ;

Col. 2, line 43, "close in the inlet" should read -- close the inlet -- .

Col. 3, line 42, "out of the chamber" should read -- out of chamber -- .

Col. 4, line 32 (Claim 6, line 7), "sad" should read -- said -- ;

Col. 4, line 47 (Claim 9, line 2), "with vent" should read -- with a vent -- ;

Col. 4, line 49 (Claim 10, line 2), "opening by" should read -- opening closed by -- ;

Col. 4, line 54 (Claim 11, line 3), a period should be inserted at the end of the claim.

Signed and Sealed this

Twenty-first Day of December 1976

[SEAL]

*Attest:*

RUTH C. MASON
*Attesting Officer*

C. MARSHALL DANN
*Commissioner of Patents and Trademarks*